United States Patent [19]

Zimmer et al.

[11] 4,201,132

[45] May 6, 1980

[54] METHOD OF AN APPARATUS FOR EQUALIZING LONGITUDINAL STRESSES IN AN ADVANCING WEB

[75] Inventors: Peter Zimmer; Hans Kudlich, both of Kufstein, Austria

[73] Assignee: Maschinenfabrik Peter Zimmer Aktiengesellschaft, Kufstein, Austria

[21] Appl. No.: 880,366

[22] Filed: Apr. 28, 1978

[51] Int. Cl.[2] ..... B41L 13/00

[52] U.S. Cl. ..... 101/118; 26/78; 26/51.5; 101/228; 101/DIG. 21; 226/2; 226/4; 226/17; 226/25; 226/42

[58] Field of Search ..... 101/118, 228, 225, 227, 101/232, DIG. 21; 26/78, 51.3–51.5; 226/2, 4, 17, 25, 42

[56] References Cited

U.S. PATENT DOCUMENTS

| | | | |
|---|---|---|---|
| 2,233,644 | 3/1941 | Smiley | 26/51.5 |
| 2,311,674 | 2/1943 | Lilja | 26/51.3 |
| 2,947,057 | 8/1960 | Meagher | 226/17 |
| 3,247,566 | 4/1966 | Burklund | 26/51.5 |
| 3,905,533 | 9/1975 | Corse | 101/228 |

*Primary Examiner*—Robert E. Bagwill
*Assistant Examiner*—A. Heinz
*Attorney, Agent, or Firm*—Montague & Ross

[57] ABSTRACT

A broad textile web, on its way to a processing station such as a rotary-screen printer, passes around a set of closely juxtaposed but independently rotatable feed rollers that are individually driven via respective differential gear trains each having a first input connected to a common drive shaft and a second input connected to an ancillary stepping motor. Each feed roller engages a strip zone of the web which is scanned by an associated sensor upstream of the roller, the latter detecting the leading and trailing edges of recurrent transverse web sections—e.g. of pile fabric—mechanically, electrically or optically distinguishable from intervening sections. Unequal longitudinal tensions in the several strip zones actuate the sensor-controlled stepping motors for different time periods so as to cancel any relative deformation. The lateral edges of a rising web portion are guided between separately driven roller pairs supported by parallelogrammatic linkages which rise or fall according to whether these rollers rotate too slow or too fast in comparison with the web speed, thereby controlling switches which either accelerate or decelerate the corresponding drive motors to keep the web edges straight.

10 Claims, 6 Drawing Figures

METHOD OF AN APPARATUS FOR EQUALIZING LONGITUDINAL STRESSES IN AN ADVANCING WEB

FIELD OF THE INVENTION

Our present invention relates to a method of and an apparatus for equalizing longitudinal stresses unavoidably occurring in a web of flexible material, especially a textile fabric of large width, advancing along a predetermined path to a processing station such as a rotary-screen printer designed to form a recurrent pattern on successive web sections of given length.

BACKGROUND OF THE INVENTION

In a screen printer as described in commonly owned prior U.S. Pat. Nos. 3,974,766 and 3,998,156, for example, it is important that the longitudinal edges of the web remain straight and parallel as it passes the several printing stages. Even if there is no lateral deviation from the prescribed path, however, developing differences in longitudinal stress throughout the width of a broad textile web may give rise to internal deformations which tend to cause irregularities in an imprinted pattern. Thus, the more highly stressed warp threads of the fabric will generally more strongly contract, on account of their inherent elasticity, after the printing operation when the web is freed from the tension imparted to it by the feed rollers serving to advance it through the processing equipment, whereby the transverse lines of the pattern are distorted.

OBJECTS OF THE INVENTION

An object of our present invention, therefore, is to provide a method of equalizing the longitudinal stresses in such a web, along with an apparatus for carrying out this method.

A related object is to provide a method of and means for maintaining or restoring the parallelism of the longitudinal edges of a web subject to different longitudinal stresses throughout its width.

SUMMARY OF THE INVENTION

In accordance with one aspect of our present invention, a web to be conducted with substantially uniform longitudinal stress to a rotary-screen printer or other processing equipment is led around a set of coaxially juxtaposed but independently rotatable feed rollers engaging respectively longitudinal strip zones thereof. The web is divided into recurrent transverse sections distinct from intervening section, the longitudinal extent or height of each such recurrent section within any strip zone being measurable by mechanical or other means as more fully discussed hereinafter. Since the height of a given section within each strip zone is initially the same, differences in that height among the several strip zones are due to unequal longitudinal tensioning of the respective warp threads (in the case of a textile fabric) resulting from nonuniform entrainment by the transport mechanism. The zonal measurements made at locations upstream of the feed rollers are therefore used, in accordance with our invention, to control the speeds of the individual rollers in a manner compensating for the relative deformations of the various subdivisions of a web section.

In the case of a tufted fabric of the type described in the above-identified patents, e.g. as used in the manufacture of printed towels, the distinctive web sections carry a relatively heavy pile which can be detected mechanically by a contact member, preferably a roller. In principle, however, such distinctive sections could also be scanned optically, or possibly electromagnetically if they are interlaced with metallic weft threads. In any event, the sections whose zonal height is to be measured need not be those to be imprinted but could also be intervening sections which may be undifferentiated from the basic web material.

In a preferred embodiment, the means for driving the several feed rollers at independently adjustable speeds comprise a differential gear train for each feed roller, that gear train having a first input coupled to a main source of motive power common to all the feed rollers and a second input coupled to the respective gear train, advantageously a stepping motor which arrests the latter input when not energized. The several stepping motors are controlled by individual sensors detecting the presence or absence of a distinctive web section at an upstream location, as discussed above.

Pursuant to another aspect of our invention, the longitudinal web edges are engaged by respective lateral guide rollers which are independently rotated by ancillary drive means substantially synchronized with the main web drive, the latter preferably including a set of coaxially juxtaposed feed rollers as described above. By detecting the tension of the web along each of its longitudinal edges, we are able to vary the operating speed of the ancillary drive means to keep these edges substantially straight.

According to a more particular feature of our invention, the lateral guide rollers are mounted in pairs on respective parallelogrammatic linkages adjacent the longitudinal web edges along a generally vertical portion of the path, each linkage being free to move substantially vertically in a direction (up or down) depending on the relative speed of the corresponding roller pair and the web. A switch controlled by that linkage varies the operating speed of the associated drive means, e.g. between two predetermined values, in a sense tending to maintain the linkage in a normal position.

BRIEF DESCRIPTION OF THE DRAWING

The above and other features of our invention will now be described in detail with reference to the accompanying drawing in which.

SPECIFIC DESCRIPTION

Figure 1:
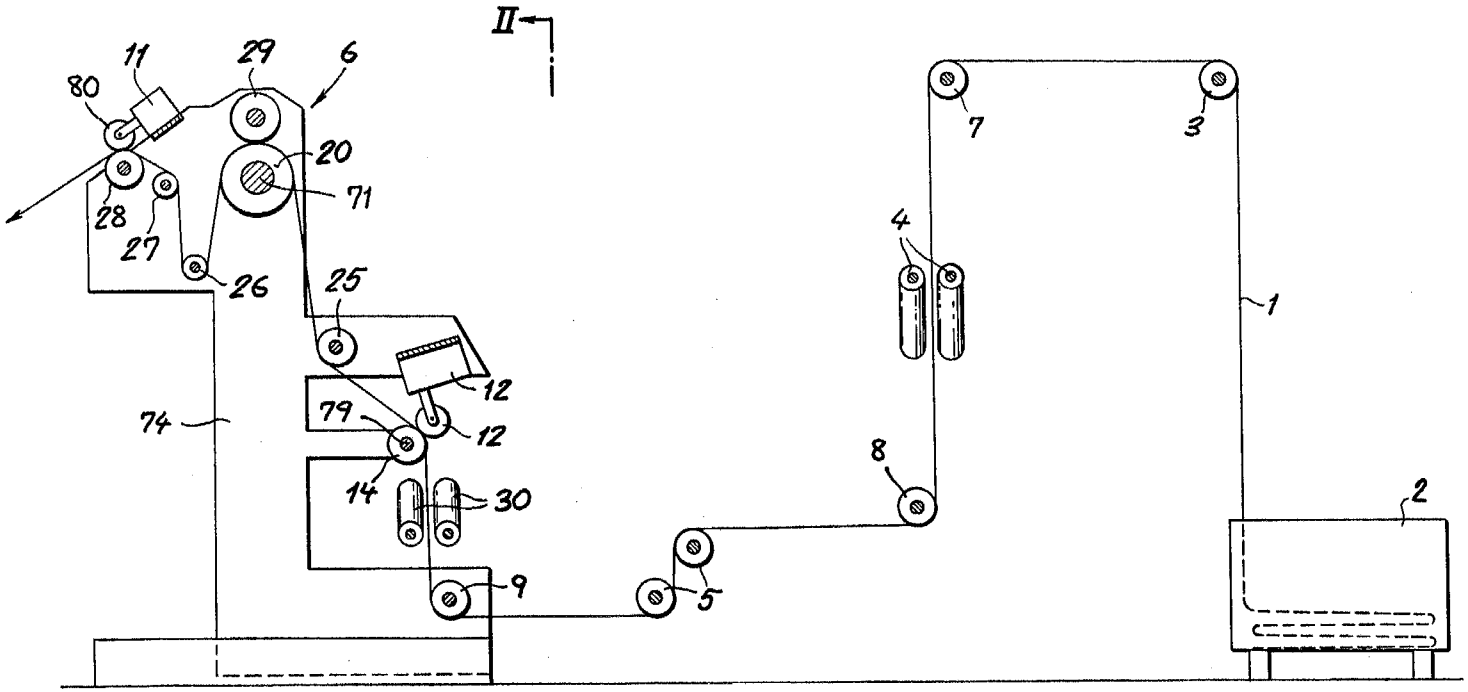
FIG. 1 is a diagrammatic elevational view of an apparatus for advancing a web to a processing station with equalization of its longitudinal stresses in accordance with our invention.

As shown in FIG. 1, a fabric web 1 originally stored in a container 2 is extracted therefrom by a transport mechanism 6 along a path including a number of horizontal deflectors, which could be idler rollers or highly polished stationary rods, designated 3, 5, 7, 8 and 9. Between deflectors 7 and 8, along a vertical stretch of its path, the opposite longitudinal edges of the web are engaged by respective pairs of lateral guide rollers 4, only one such pair being visible in FIG. 1. Two similar pairs of guide rollers 30 engage the lateral web edges along a rising path portion just beyond deflector 9. Deflectors 5 act as frictional brakes designed to impart a certain tension to the web entrained by the transport mechanism 6.

Figure 2:
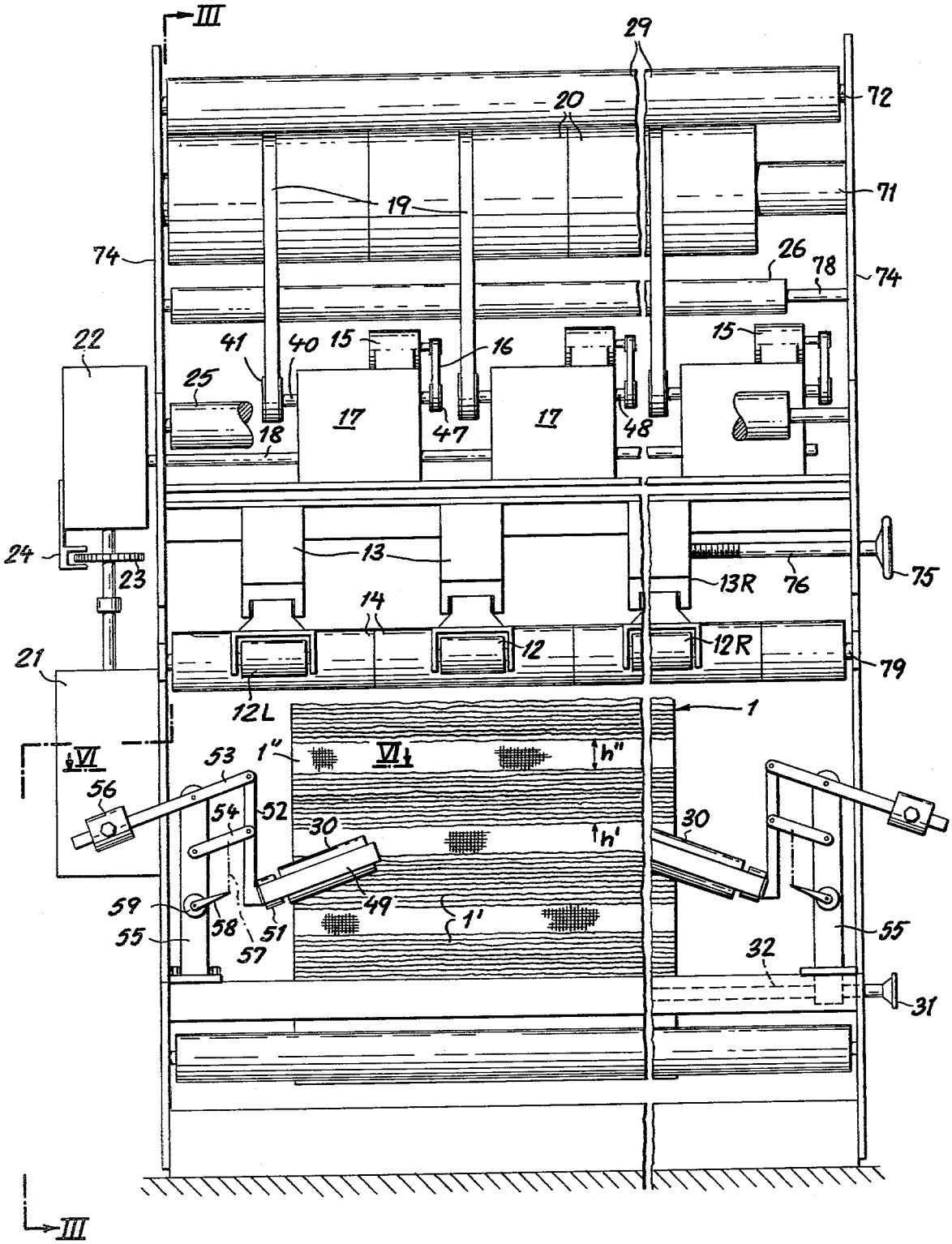
FIG. 2 is an elevational view (with parts broken away) taken along the line II—II of FIG. 1 but drawn to a larger scale, showing structural details of the apparatus.
Figure 3:
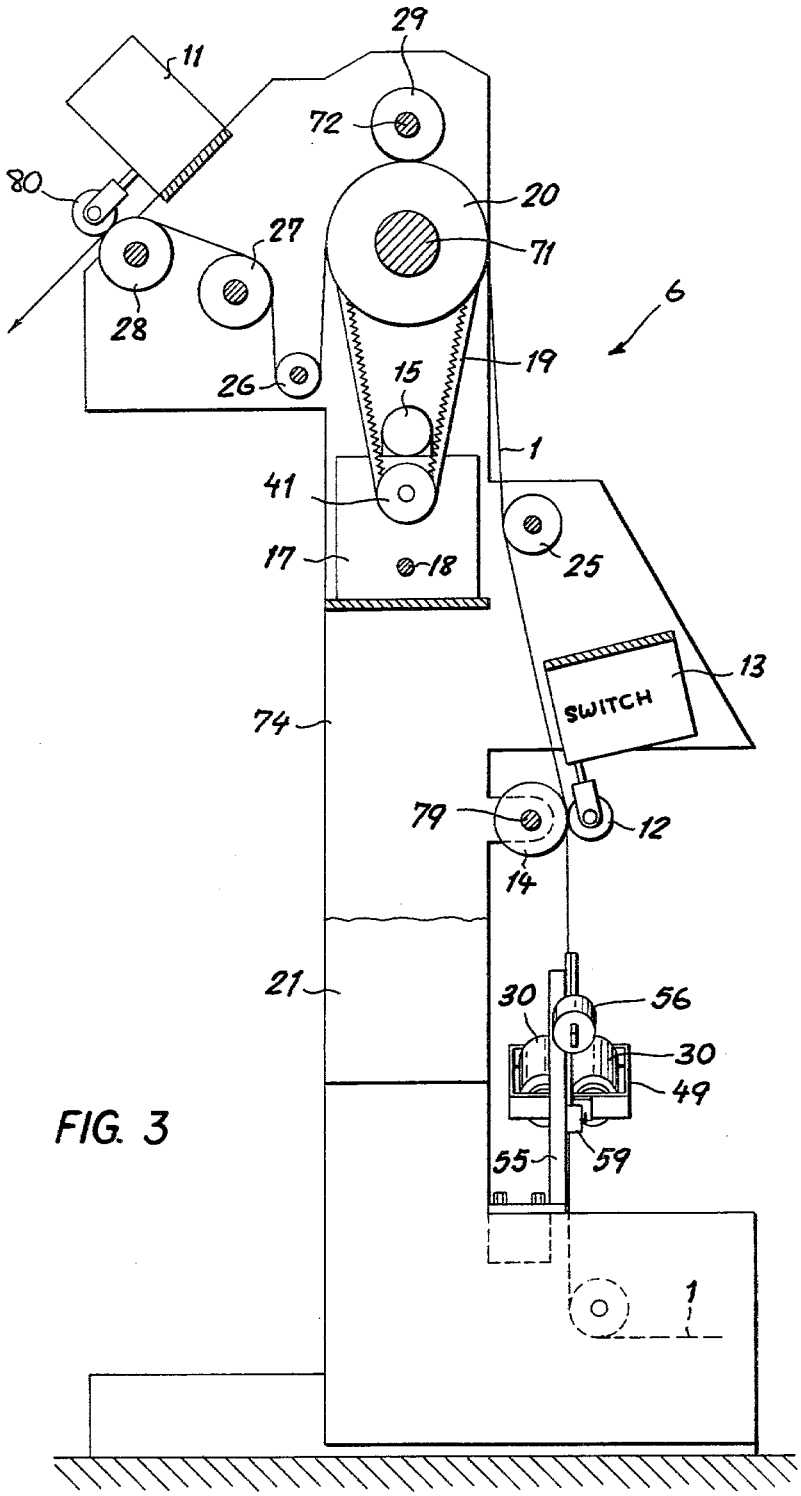
FIG. 3 is a part-sectional view taken on the line III—III of FIG. 2.
Figure 4:
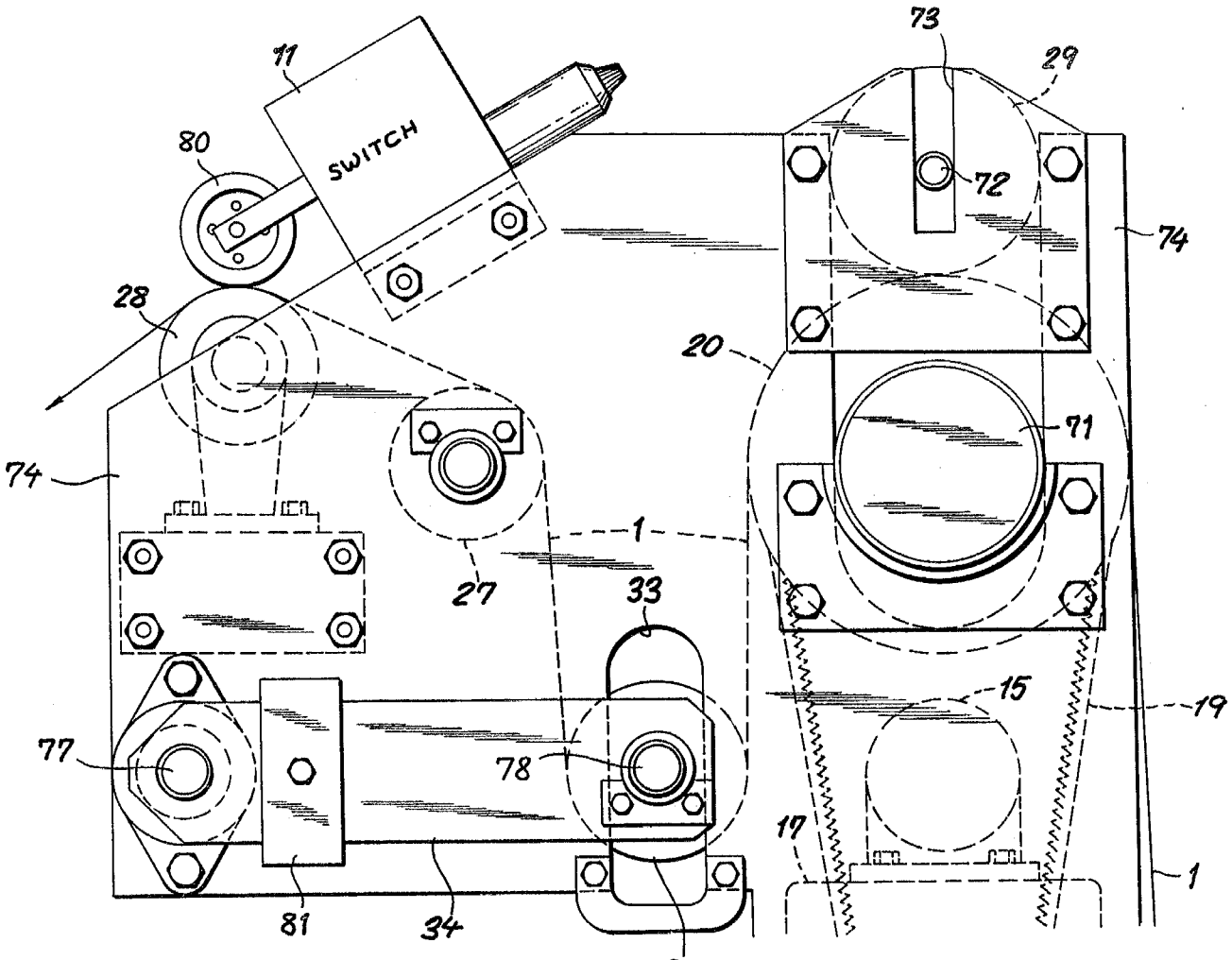
FIG. 4 is an enlarged side-elevational view of the upper part of the structure shown in FIG. 3.

This transport mechanism, more fully illustrated in FIGS. 2–4, comprises a set of closely juxtaposed but independently rotatable cylindrical feed or traction rollers 20 of like diameter idling on a common axle 71. The feed rollers 20, which are advantageously provided with a high-friction coating, coact with a common pressure roller 29 having a shaft 72 guided in slots 73 of a machine frame 74 so as to bear upon the feed rollers under its own weight and to facilitate disengagement therefrom. The feed rollers 20 are individually driven by toothed belts 19 engaging sprocket wheels 41 each carried on an output shaft 40 of a respective differential-gear train 17 more fully illustrated in FIG. 5. A throughgoing shaft 18, common to all the differential-gear trains 17, is driven by a main motor 21 via a bevel-gear transmission 22 also serving as a speed reducer. Another input of each differential-gear train 17 is constituted by a stub shaft 48 carrying a sprocket 47 which is engaged by a toothed belt 16, the latter being driven by a stepping motor 15 individual to the respective feed roller 20. The several stepping motors 15 have energizing circuits closable by switches 13 which are controlled by respective sensing rollers 12 resting against the tufted surface of web 1. Each roller 12 scans a central area of a relatively narrow longitudinal strip zone whose width corresponds to that of the respective feed roller 20. Advantageously, the outermost sensing rollers 12L and 12R are always aligned with the left-hand and the right-hand longitudinal web edge, respectively. To maintain such alignment with webs of different widths, the mounting of roller 12R and of the associated switch 13R may be transversely shiftable with the aid of a handwheel 75 on a leadscrew 76. In the case of narrower webs, one or more of the outlying sensing rollers may be deactivated in order to prevent useless switching of the associated stepping motor or motors.

The web 1 passes between the sensing rollers 12 and respective counterrollers 14 idling on a common axle 79. After passing another deflecting roller 25, it travels in a vertical loop around the set of feed rollers 20 at the top of that loop and then descends on the opposite side of the feed rollers, forming a bight in which a weighting roller 26 is cradled. As illustrated in FIG. 4, roller 26 is journaled at the free ends of a pair of swingable arms 34 (only one shown) pivoted at 77 to the machine housing 74. The shaft 78 of weighting roller 26 passes through slots 33 in the housing walls. A weight 81 shiftable along each arm 34 facilitates adjustment of the pressure with which the roller 26 loads the web 1. The web then continues around a deflecting roller 27 and a backing roller 28 confronting another sensing roller 80 which controls a switch 11. The latter transmits a timing pulse to a screen printer, such as the one shown in U.S. Pat. Nos. 3,974,766 and 3,998,156, upon detecting the leading edge of a tufted web section to be imprinted; switch 11 and roller 80, accordingly, replace the sensor 18 shown in these two prior patents. A toothed wheel 23 driven by motor 21 coacts with a photosensor 24 to generate a pulse train for stepping the ancillary motors 15 at a rate related to the speed of main motor 21.

FIG. 2 shows the web 1 as having tufted sections 1′ alternating with intervening sections 1″ of the basic fabric, these sections having respective heights h′ and h″ which are theoretically constant throughout the widths of the web but actually vary, from one strip zone to the next, on account of differences in longitudinal tension as already explained. A roller 12 sensing the trailing edge of a tufted section 1′ closes the associated switch 13 so as to energize the corresponding stepping motor 15 until the arrival of the leading edge of the next tufted section. Thus, each motor 15 remains energized for a period which is proportional to the height h″ of an intervening fabric section 1″. During this operating period the motor is advanced by a multiplicity of steps, in response to pulses from generator 23, 24, whose number is proportional to the measured height h″ so that the stepping motors associated with more highly tensioned strip zones operate for longer periods. The rotary speed of each stepping motor is differentially combined with that of shaft 18 within the corresponding gear trains 17 whereby the average speed of the respective feed roller 20 varies inversely with the tension of its strip zone. This insures the desired equalization of tension downstream of transport mechanism 6.

Figure 5:
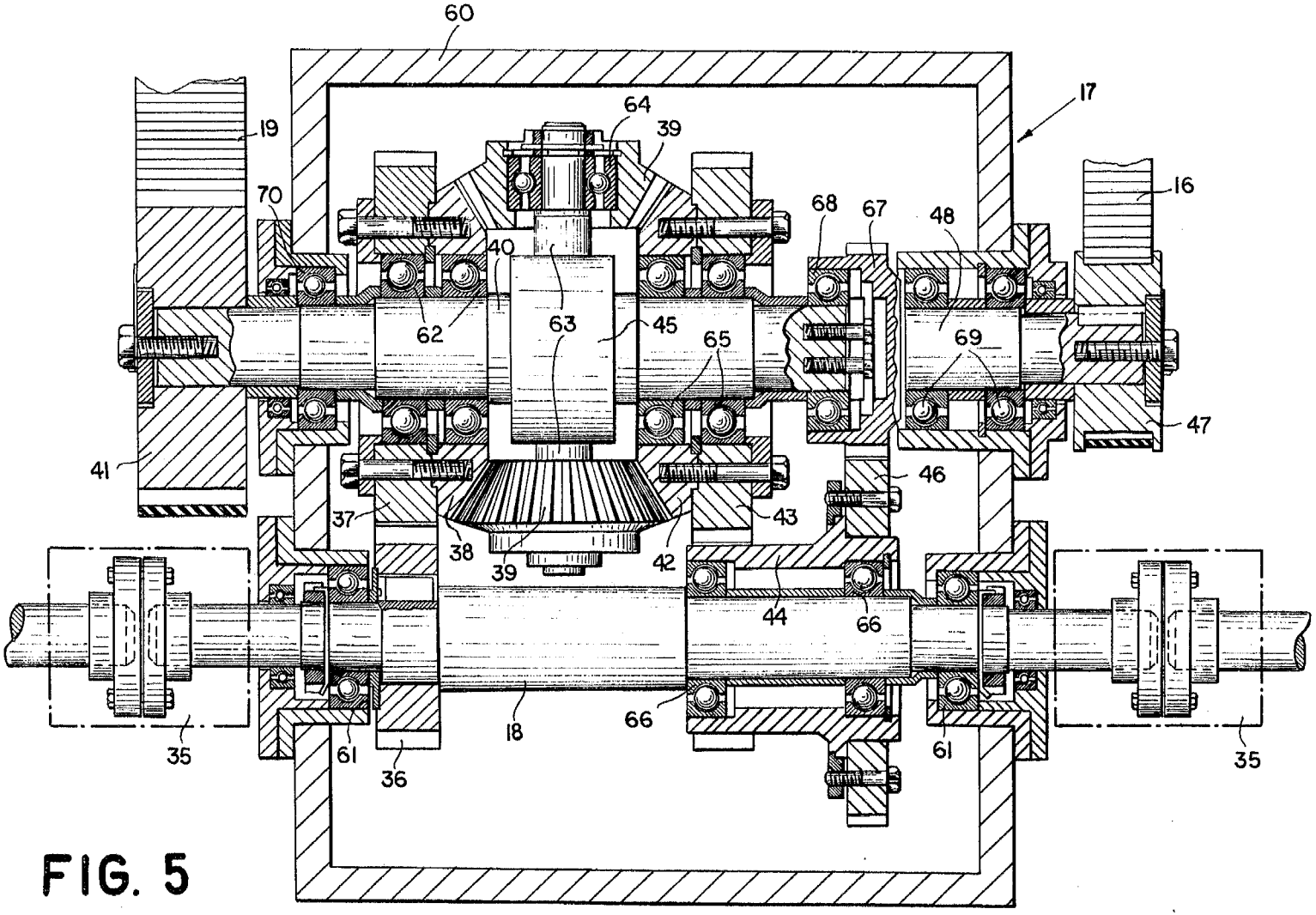
FIG. 5 is an enlarged cross-sectional view of a planetary-gear transmission included in the apparatus.

In FIG. 5 we have shown details of a representative planetary-gear transmission 17.

A housing 60 is traversed by the main drive shaft 18 which, for conveniences of assembly and disassembly, is divided into a number of sections interconnected by couplings 35. Input shaft 18, journaled in bearings 61, drives a spur gear 36 which meshes with a spur gear 37 fixedly secured to a bevel gear 38. Gears 37 and 38 are freely rotatable on an output shaft 40 on which they are supported by bearings 62. A ring 45 keyed to shaft 40 is integral with a pair of diametricaly opposite axles 63 on which two bevel gears 39 in mesh with bevel gear 38 are freely rotatable with the aid of bearings 64. Bevel gears 39 mesh with a further bevel gear 42 rotatably supported on shaft 40 via a bearing 65 and fixedly connected with another spur gear 43 engaging a toothed sleeve 44 which idles on shaft 18 through the intermediary of bearings 66. A spur gear 46 firmly clamped to sleeve 44 meshes with another spur gear 67 which is supported on shaft 40 through a bearing 68 and is rigid with a stub shaft 48 having the sprocket 47 keyed to it. Ancillary input shaft 48 is journaled in housing 60 via bearings 69. The opposite end of output shaft 40, carrying the sprocket 41, is journaled in the housing by a bearing 70.

As long as gear 47 is held stationary by the corresponding stepping motor 15 (FIG. 2) through the toothed belt 16, sprocket 41 is driven from shaft 18 through gear train 36–39 at half the speed of gear 37; the latter speed, of course, depends on the tooth ratio fo gears 36 and 37. Energization of the associated stepping motor 15 drives the gear train 47, 67, 46, 44, 43, 42 in a sense diminishing the speed shaft 40 for the purpose of reducing the tension imparted to the corresponding strip zone of web 1 by the traction roller 20 (FIG. 2) connected with sprocket 41 via toothed belt 19.

Figure 6:
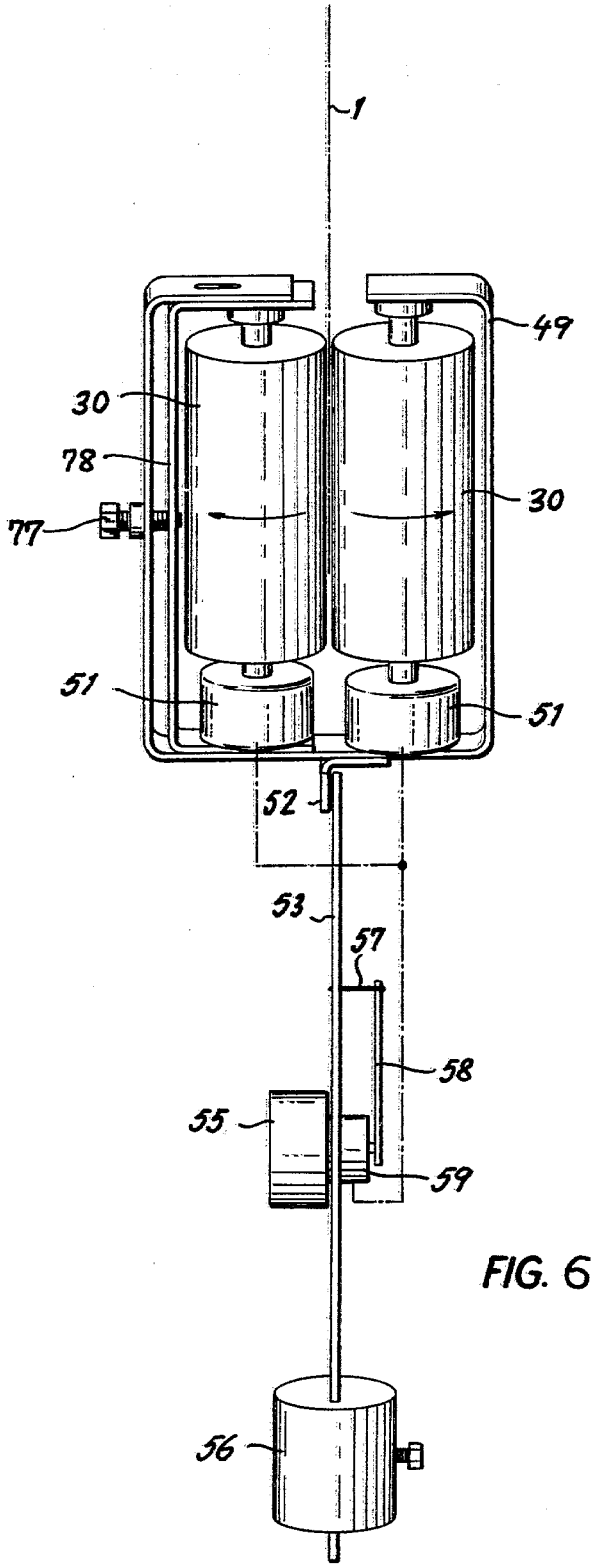
FIG. 6 is an enlarged top view of a detail as seen on the line VI—VI of FIG. 2.

We shall now describe, with reference to FIGS. 2, 3 and 6, the construction of the lateral web guides including the rollers 30 also shown in FIG. 1. It will be understood that the guide rollers 4 of FIG. 1 also may form part of a similar assembly.

Rollers 30 are oppositely driven by a pair of synchronized motors 51 supported together with these rollers in a generally C-shaped frame 49 which has a gap for the passage of web 1. The relative spacing of the rollers is adjustable by a screw 77 engaging a bracket 78 which holds one of these rollers and the associated motor 51. The common energizing circuit of the two motors includes a switch 59 allowing a changeover between two predetermined operating speeds. A master switch for the energization of motors 21 and 51 has not been illustrated.

Frame 49 is carried on a vertical arm 52 of a parallelogrammatic linkage which includes an upright 55 rigid with machine frame 74. The linkage further comprises two parallel arms 53 and 54, arm 53 carrying an adjustable weight 56 to vary the angle of inclination of frame 49 and rollers 30. Arm 54 is connected via a link 57 with an operating lever 58 which reverses the swtich 59 whenever the rollers 30 pass a certain level. Thus, if the general web speed determined by traction rollers 20 exceeds the vertical component of the peripheral speed of rollers 30, the increased tension along the web edges elevates these rollers whereby lever 58 is swung counterclockwise to switch to the higher operating speed. As a result, the edge tension decreases and the assembly 30, 49–59 shifts to lower the rollers 30 until the position of switch 59 is reversed to restore the previous speed. In this manner, the average speed of each lateral roller pair 30 is maintained at a value corresponding to that of the traction rollers 20. Thus, these lateral rollers assist the traction rollers controlled by sensing rollers 12L and 12R in keeping the tension substantially uniform throughout the width of the web.

the separation of the two roller pairs 30 shown in FIG. 2 can be adjusted, in order to accommodate webs of different width, by a handwheel 31 engaging the right-hand upright 55 through a leadscrew 32.

The inclination of the roller pairs 30 and 4 relative to the horizontal (and therefore to the direction of the weft threads of the fabric) is so chosen that their axes intersect near a midplane of the web 1 at a downstream location, i.e. below the level of rollers 4 on a descending portion and above the level of rollers 30 on an ascending porton of the web. This orientation ensures a transverse tensioning of the web, to an extent dertermined by the angle of inclination. If the rollers were not driven, as described above with reference to roller pairs 30, their presence would inevitably increase the longitudinal web tension in the vicinity of the edges. Obviously, a switchover mechanism controlled by a parallelogrammatic linkage associated with rollers 4 would have to reduce the roller speed upon a rise to a higher level.

It will be understood that the binary switchover between two fixed roller speeds may be replaced by a continuous speed variation, as by means of potentiometer within switch 59.

We claim:

1. An apparatus for equalizing longitudinal stresses in a web of flexible material advancing along a predetermined path, comprising:

central roller means extending transversely across said path;

main drive means for rotating said central roller means to entrain a web engaged thereby;

two lateral roller pairs positioned to engage opposite longitudinal edges of said web at a location upstream of said central roller means;

separate ancillary drive means for independently rotating said lateral roller pairs in substantial synchronism with said central roller means and at peripheral speeds having velocity components parallel to said longitudinal edges approximately equaling the speed of the entrained web at said longitudinal edges;

individual mounting means for each of said lateral roller pairs enabling limited displacement thereof in a direction generally parallel to said longitudinal edges in response to any deviation of said velocity components from the web speed at the respective longitudinal edges; and switch means coupled to said mounting means for varying the speed of said ancillary drive means upon a displacement of either of said lateral roller pairs generally parallel to said longitudinal edges from a predetermined position in a sense tending to return the respective lateral roller pair to said predetermined position thereof.

2. An apparatus as defined in claim 1 wherein said lateral roller pairs are disposed along a grenerally vertical portion of said path.

3. An apparatus as defined in claim 2 wherein said mounting means comprises a parallelogrammatic linkage supporting each of said lateral roller pairs with freedom of substantially vertical movement.

4. An apparatus as defined in claim 3 wherein said linkage is equipped with shiftable weight means providing an adjustable restoring force for the establishment of said predetermined position.

5. An apparatus as defined in claim 3 wherein said lateral roller pairs have inclined axes intersecting near a midplane of said web at a location further downstream.

6. An apparatus as defined in claim 1, 2, 3, 4 or 5 wherein the web is provided with recurrent transverse sections distinct from intervening sections, said central roller means including a set of coaxially juxtaposed but independently rotatable feed rollers extending transversely across said path, each feed roller engaging a respective longitudinal strip zone of said web, further comprising a set of sensors disposed close to said strip zones along said path at a location upstream of said feed rollers for detecting the presence of a distinctive transverse section on the corresponding strip zone, said main drive means including an individual drive unit for each of said feed rollers responsive to signals from the associated sensors for rotating said feed rollers at speeds depending upon the longitudinal extent of any of said recurrent sections in each strip zone to compensate for relative deformations of said strip zones due to unequal longitudinal tensions.

7. An apparatus as defined in claim 6 wherein said individual drive units each a differential gear train with two inputs and an ancillary source of motive power coupled to one of said inputs, the other of said inputs being coupled to a main source of motive power common to all said feed rollers.

8. An apparatus as defined in claim 7 wherein said ancillary source of motive power is a stepping motor.

9. An apparatus as defined in claim 6 wherein said web consists of textile material and said recurrent sections carry tufts forming a pile fabric, said sensors comprising contact members bearing upon the tufted surface of said web.

10. An apparatus as defined in claim 6 wherein said feed rollers closely adjoin one another.

* * * * *